US010388427B2

(12) United States Patent
Matsuo et al.

(10) Patent No.: US 10,388,427 B2
(45) Date of Patent: Aug. 20, 2019

(54) FLAT CABLE, METHOD FOR MANUFACTURING THE SAME, AND ROTATABLE CONNECTOR DEVICE INCLUDING THE SAME

(71) Applicants: Furukawa Electric Co., Ltd., Tokyo (JP); Furukawa Automotive Systems Inc., Shiga (JP)

(72) Inventors: Ryosuke Matsuo, Tokyo (JP); Kengo Mitose, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 15/957,537

(22) Filed: Apr. 19, 2018

(65) Prior Publication Data

US 2018/0247734 A1 Aug. 30, 2018

Related U.S. Application Data

(63) Continuation of application No. PCT/JP2017/025928, filed on Jul. 18, 2017.

(30) Foreign Application Priority Data

Sep. 20, 2016 (JP) ..... 2016-182882

(51) Int. Cl.
*H01B 7/08* (2006.01)
*H01B 9/00* (2006.01)
(Continued)

(52) U.S. Cl.
CPC ..... *H01B 7/08* (2013.01); *H01B 7/0838* (2013.01); *H01B 9/003* (2013.01); *H01B 9/006* (2013.01); *H01B 7/0009* (2013.01); *H01B 7/04* (2013.01)

(58) Field of Classification Search
CPC ..... H01B 7/08
(Continued)

(56) References Cited

U.S. PATENT DOCUMENTS 4,289,558 A * 9/1981 Eichenbaum ..... G02B 6/448 156/179
6,688,898 B2 * 2/2004 Nisimoto ..... B60R 16/027 439/15
(Continued)

FOREIGN PATENT DOCUMENTS

JP 11111070 A 9/1999
JP 4734695 B 1/2002
JP 3633302 B 3/2005

OTHER PUBLICATIONS

International Search Report and Written Opinion dated Oct. 3, 2017 for PCT App. No. PCT/JP2017/025928 (Engl. translation of ISR only).

*Primary Examiner* — Chau N Nguyen
(74) *Attorney, Agent, or Firm* — Dorsey & Whitney LLP

(57) ABSTRACT

A flat cable includes a predetermined number of conductors, a pair of insulating films disposed in such a manner as to sandwich the predetermined number of conductors, and an adhesive layer provided between the pair of insulating films. The conductors each satisfies $Y \geq 1.2 \times t \times E/(2X-t)$ within a range of bending radius of 4 mm to 8 mm, where X (mm) denotes bending radius, Y (MPa) denotes 0.2% yield stress, t (mm) denotes thickness, and E (MPa) denotes Young's modulus. The conductors each has an electrical conductivity of greater than or equal to 50% IACS.

11 Claims, 1 Drawing Sheet

(51) Int. Cl.
*H01B 7/00* (2006.01)
*H01B 7/04* (2006.01)

(58) Field of Classification Search
USPC ..... 174/117 F, 117 FF, 117 A
See application file for complete search history.

(56) References Cited

U.S. PATENT DOCUMENTS

2005/0077074 A1* 4/2005 Tanaka ..... H01B 7/0009
174/117 F
2010/0072584 A1* 3/2010 Aruga ..... C22C 9/00
257/666
2012/0018192 A1* 1/2012 Takahashi ..... C22C 9/00
174/128.1
2012/0097422 A1* 4/2012 Sumi ..... H01B 1/026
174/117 F
2012/0241056 A1* 9/2012 Sato ..... C22C 9/06
148/554
2012/0255761 A1* 10/2012 Shanai ..... C09J 177/08
174/117 F
2014/0091655 A1* 4/2014 Kajita ..... H02K 3/522
310/71
2014/0116583 A1* 5/2014 Kamada ..... H01B 1/026
148/682

* cited by examiner

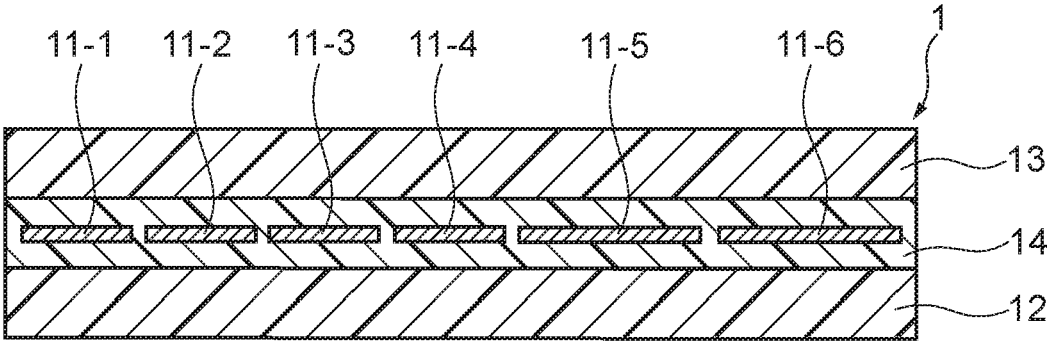
1
11-1
11-2
11-3
11-4
11-5
11-6
13
14
12

FLAT CABLE, METHOD FOR MANUFACTURING THE SAME, AND ROTATABLE CONNECTOR DEVICE INCLUDING THE SAME

CROSS REFERENCE TO RELATED APPLICATIONS

This is a continuation application of International Patent Application No. PCT/JP2017/025928 filed Jul. 18, 2017, which claims the benefit of Japanese Patent Application No. 2016-182882 filed Sep. 20, 2016. The priority applications are hereby incorporated by reference in their entirety for any purpose.

TECHNICAL FIELD

The present disclosure relates to a flat cable, a method for manufacturing the flat cable, and a rotatable connector device including the flat cable, in particular, to a flexible flat cable to be disposed in a rotatable connector device for a vehicle.

BACKGROUND

In the related art, in a vehicle such as a four-wheel vehicle, a rotatable connector device (SRC: Steering Roll Connector) for supplying power to an airbag device and other devices is mounted in a coupling portion between a steering wheel for steering and a steering shaft. The rotatable connector device includes a stator, a rotator that is assembled to the stator in a freely rotatable manner, and a flexible flat cable (FFC) that is wound and housed in an annular internal space formed by the stator and the rotator, and an end portion of the FFC includes a connecting structure that electrically connects the FFC and an outside.

The FFC includes a plurality of conductors that are arranged in parallel, a pair of insulating films that are arranged so as to sandwich the plurality of conductors, and an adhesive layer provided between the pair of insulating films, and has a laminated structure formed by the above plurality of conductors, the pair of insulating films and the adhesive layer. The conductors are made of, for example, a tough pitch copper, an oxygen-free copper, or the like. In addition, the insulating films each include an adhesive layer that is made of a polyester-based, polyurethane-based, polyamide-based, or polystyrene-based resin, and by bonding the above pair of insulating films with the adhesive layers interposed therebetween and with the plurality of conductors sandwiched therebetween, the conductors are insulated from each other, or the conductors are insulated from an outside.

As the above conductor, for example, there is proposed a conductor for a flat cable made of a copper alloy to which one or more kinds of B, Sn, In, and Mg are added at 0.005 to 0.045% in total, and in which crystal grains are refined to 7 μm or smaller (Japanese Patent No. 3633302).

As another conductor, there is proposed a flat conductor obtained by performing heat treatment on a flat-shaped conductor that includes a base metal being a copper alloy that is an oxygen-free copper (99.999 wt % Cu) to which 0.3 wt % or less of Sn and 0.3 wt % or less of In or Mg are added, or being a copper alloy that is an oxygen-free copper (99.999 wt % Cu) to which 10 wt % or less of Ag is added and that includes a surface on which Sn is plated, the flat conductor having a tensile strength of 350 MPa or higher, an elongation of 5% or more, and an electrical conductivity of 70% IACS or higher (Japanese Patent No. 4734695).

However, in the technique of Japanese Patent No. 3633302, merely performing grain size control by defining the kinds and contents of the additional elements in the copper alloy provides insufficient bending property of the conductor.

In addition, in the technique of Japanese Patent No. 4734695, although it is described that an elongation of 5% or greater is essential, and when the elongation is out of the range, the rigidity is high, which makes it difficult to fold or bend the conductor and may cause the conductor to buckle when folding or bending the conductor, it is revealed that a bending property of the conductor is insufficient even when the elongation is 5% or greater. In particular, in recent years, with the development of automobiles having higher performance and higher functions, improvement in durabilities of various devices and equipment installed in an automobile may be needed from the viewpoint of improvement of reliability, safety, and the like, and further improvement of the bending property of a flat cable used in a rotatable connector device or the like may be needed.

SUMMARY

The present disclosure is related to providing a flat cable, a method for manufacturing the flat cable, and a rotatable connector device including the flat cable, the flat cable having a good folding property and inhibiting occurrence of buckling while maintaining an electrical conductivity equivalent to an electrical conductivity of a flat cable of the related art, so as to achieve further improvement in a bending property.

The present inventor carried out assiduous studies, and as a result, found a relationship between a bending radius, a conductor thickness, and Young's modulus of a flat cable and a 0.2% yield stress of the flat cable at a time when a predetermined number of bendings to break is exceeded, and also found that, by defining additional elements and a range of content of each of the elements in a copper alloy and by further performing appropriate microstructure control on grains and precipitates in a texture, a sufficient elasticity can be obtained and a good folding property can be obtained while inhibiting occurrence of buckling, and by an appropriate yield stress, a bending property can be further improved.

According to a first aspect of the present disclosure, a flat cable may include a predetermined number of conductors, a pair of insulating films disposed in such a manner as to sandwich the predetermined number of conductors, and an adhesive layer provided between the pair of insulating films, the conductors each satisfying $Y \geq 1.2 \times t \times E/(2X-t)$ within a range of bending radius of 4 mm to 8 mm, where X (mm) denotes bending radius, Y (MPa) denotes 0.2% yield stress, t (mm) denotes thickness, and E (MPa) denotes Young's modulus, the conductors each having an electrical conductivity of greater than or equal to 50% IACS.

According to a second aspect of the present disclosure, a method for manufacturing a flat cable is provided, the flat cable may include a predetermined number of conductors, a pair of insulating films disposed in such a manner as to sandwich the predetermined number of conductors, and an adhesive layer provided between the pair of insulating films, the conductors each satisfying $Y \geq 1.2 \times t \times E/(2X-t)$ within a range of bending radius of 4 mm to 8 mm, where X (mm) denotes bending radius, Y (MPa) denotes 0.2% yield stress, t (mm) denotes thickness, and E (MPa) denotes Young's modulus, the conductors each having an electrical conductivity of greater than or equal to 50% IACS, the method including preparing a predetermined number of conductors each having a width-direction cross-sectional area of less than or equal to 0.75 $mm^2$, and sandwiching the predetermined number of conductors by a pair of insulating films with an adhesive interposed therebetween, with a tension of greater than or equal to 0.3 kgf applied to each of the predetermined number of conductors.

According to a third aspect of the present disclosure, a rotatable connector device including a flat cable is provided, the flat cable may include a predetermined number of conductors, a pair of insulating films disposed in such a manner as to sandwich the predetermined number of conductors, and an adhesive layer provided between the pair of insulating films, the conductors each satisfying $Y \geq 1.2 \times t \times E/(2X-t)$ within a range of bending radius of 4 mm to 8 mm, where X (mm) denotes bending radius, Y (MPa) denotes 0.2% yield stress, t (mm) denotes thickness, and E (MPa) denotes Young's modulus, the conductors each having an electrical conductivity of greater than or equal to 50% IACS. A 0.2% yield stress of the flat cable in a longitudinal direction of the flat cable after 200000 bending movements that are performed with a bending radius of less than or equal to 8 mm being kept is greater than or equal to 80% of a 0.2% yield stress of the flat cable in the longitudinal direction before the bending movements.

With the flat cable according to the present disclosure, it may be possible to improve bendability and buckling resistance by making the strength appropriate, and to decrease the elongation by making the yield stress appropriate, and an excellent bending property can be thereby obtained. Therefore, in a case where a steering wheel is steered in a vehicle, and the flat cable in the rotatable connector device is repeatedly subjected to bending movement with a clockwise rotation or a counterclockwise rotation of the steering wheel, it is possible to further improve the bending property of the flat cable, and it is possible to inhibit plastic deformation as much as possible even after several hundreds of thousands of bending movements are performed. Thus, a flat cable having improved durability, as well as improved reliability and safety can be provided.

In addition, the flat cable according to the present disclosure may be useful not only for a rotatable connector device called a steering rolling connector (SRC) but also, for example, an automotive component such as a roof harness, a door harness, and a floor harness, a folding portion of a clamshell mobile phone, a movable part of a digital camera or a printer head, and a wiring body of a driving unit and the like of an HDD (Hard Disk Drive), DVD (Digital Versatile Disc), Blu-ray (R) Disc, or CD (Compact Disc).

BRIEF DESCRIPTION OF DRAWINGS

FIG. 1 is a width-direction cross-sectional view illustrating a configuration of a flat cable according to an embodiment of the present disclosure.

DETAILED DESCRIPTION

Hereinafter, embodiments of the present disclosure will be described in detail with reference to the drawings.

[Configuration of Flat Cable]

A flat cable 1 of the present embodiment includes, as illustrated in FIG. 1, for example, a plurality of conductors 11-1, 11-2, 11-3, 11-4, 11-5, and 11-6 (a predetermined number of conductors), a pair of insulating films 12 and 13 disposed in such a manner as to sandwich the plurality of conductors, and an adhesive layer 14 provided between the pair of insulating films 12 and 13. The flat cables 1 of the present embodiment are each, for example, a flexible flat cable (FFC).

The conductors 11-1 to 11-6 are arranged in such a manner that in-plane directions of rolling surfaces of the conductors are substantially the same with the insulating film 12 being provided on one rolling surface of each of these conductors and the insulating film 13 being provided on the other rolling surface of each of these conductors. The conductors 11-1 to 11-6 are 0.1 mm to 15 mm in width, preferably 0.3 mm to 15 mm in width, and 0.02 mm to 0.05 mm in thickness. Width-direction cross-sectional areas of the conductors 11-1 to 11-6 are each 0.75 $mm^2$ or smaller, preferably 0.02 $mm^2$ or smaller.

The adhesive layer 14 has a thickness sufficient for embedding the conductors 11-1 to 11-6 and is sandwiched by the insulating films 12 and 13. The adhesive layer 14 is made of a well-known adhesive applicable to the pair of insulating films 12 and 13.

The pair of insulating films 12 and 13 is made of a resin capable of exhibiting a good adhesiveness property to the adhesive layer 14 and/or the conductors 11-1 to 11-6. In addition, as a suitable example, the pair of insulating films 12 and 13 may be each made up of two layers: an outer-most layer made of a polyethylene terephthalate, which has a melting point of 200° C. or higher, so as not to melt when adhesive layers on the pair of insulating films 12 and 13 are melted; and an adhesive layer made of a polyester-based resin. The insulating films 12 and 13 are each, for example, 6 mm to 15 mm in width and 0.01 mm to 0.05 mm in thickness.

The flat cable 1 having the above configuration may be preferably applied to a rotatable connector device. In such a case, the rotatable connector device includes the flat cable 1 wound and housed in an internal space having an annular shape, the internal space being formed by a stator and a rotator that are not illustrated. For example, in the rotatable connector device, the flat cable 1 has, a folded-back portion that is bent and folded back at a middle section in a longitudinal direction of the flat cable 1, not illustrated, and the flat cable 1 is wound up or rewound with the bending kept at the folded-back portion. The folded-back portion is wound up or rewound with a fold-back, with the bending radius kept at 4 mm to 8 mm.

[Chemical Composition of Conductors]

The conductors each contain one or more of 0.1 to 0.8 mass % of tin (Sn), 0.05 to 0.8 mass % of magnesium (Mg), 0.01 to 0.5 mass % of chromium (Cr), 0.1 to 5.0 mass % of zinc (Zn), 0.02 to 0.3 mass % of titanium (Ti), 0.01 to 0.2 mass % of zirconium (Zr), 0.01 to 0.3 mass % of iron (Fe), 0.001 to 0.2 mass % of phosphorus (P), 0.01 to 0.3 mass % of silicon (Si), 0.01 to 0.3 mass % of silver (Ag), and 0.1 to 1.0 mass % of nickel (Ni), with a balance comprising or consisting of copper (Cu) and inevitable impurities.

<Tin: 0.1 to 0.8 Mass %>

Tin is an element having a function of high strengthening when added and solid-solved in copper. With a content of tin of less than 0.1 mass %, the effect is insufficient, and with a content of tin of more than 0.8 mass %, it is difficult to keep an electrical conductivity at greater than or equal to 50%. The content of tin is therefore 0.1 to 0.8 mass % in the present embodiment.

<Magnesium: 0.05 to 0.8 Mass %>

Magnesium is an element having a function of high strengthening when added and solid-solved in copper. With a content of magnesium of less than 0.05 mass %, the effect is insufficient, and with a content of magnesium of more than 0.8 mass %, it is difficult to keep an electrical conductivity of the conductors at greater than or equal to 50%. The content of magnesium is therefore 0.05 to 0.8 mass % in the present embodiment.

<Chromium: 0.01 to 0.5 Mass %>

Chromium is an element having a function of high strengthening when added and solid-solved in copper, and finely precipitated. With a content of chromium of less than 0.01 mass %, precipitation hardening cannot be expected and a yield stress is insufficient, and with a content of chromium of more than 0.5 mass %, coarse crystallized grains and precipitates develop, causing degradation in fatigue property, which is inappropriate. The content of chromium is therefore 0.01 to 0.5 mass % in the present embodiment.

<Zinc: 0.1 to 5.0 Mass %>

Zinc is an element having a function of high strengthening when added and solid-solved in copper. With a content of zinc of less than 0.1 mass %, solid-solution hardening cannot be expected and a yield stress is insufficient, and with a content of zinc of more than 5.0 mass %, it is difficult to keep the electrical conductivity at greater than or equal to 50%. The content of zinc is therefore 0.1 to 5.0 mass % in the present embodiment.

<Titanium: 0.02 to 0.3 Mass %>

Titanium is an element having a function of high strengthening when added and solid-solved in copper, and precipitating finely. With a content of titanium of less than 0.02 mass %, precipitation hardening cannot be expected and a yield stress is insufficient, and with a content of titanium of more than 0.3 mass %, it is difficult to keep the electrical conductivity at greater than or equal to 50%, causes coarse crystallized grains and precipitates to develop, causing degradation in fatigue property, which is inappropriate, and results in a significantly poor productivity. The content of titanium is therefore 0.02 to 0.3 mass % in the present embodiment.

<Zirconium: 0.01 to 0.2 Mass %>

Zirconium is an element having a function of high strengthening when added and solid-solved in copper, and finely precipitated. With a content of zirconium of less than 0.01 mass %, precipitation hardening cannot be expected and a yield stress is insufficient, and a content of zirconium more than 0.2 mass % causes coarse crystallized grains and precipitates to develop, causing degradation in fatigue property, which is inappropriate, and results in a significantly poor productivity. The content of zirconium is therefore 0.01 to 0.2 mass % in the present embodiment.

<Iron: 0.01 to 3.0 Mass %>

Iron is an element having a function of high strengthening when added and solid-solved in copper, and finely precipitated. With a content of iron of less than 0.01 mass %, precipitation hardening cannot be expected and a yield stress is insufficient, and with a content of iron of more than 3.0 mass %, it is difficult to keep the electrical conductivity at greater than or equal to 50%. The content of iron is therefore 0.01 to 3.0 mass % in the present embodiment.

<Phosphorus: 0.001 to 0.2 Mass %>

Phosphorus is an element having a function of deoxidation and an element that improves not properties but the productivity. With a content of phosphorus of less than 0.001 mass %, an improvement effect in terms of production is insufficient, and with a content of phosphorus of more than 0.2 mass %, it is difficult to keep the electrical conductivity at greater than or equal to 50%. The content of phosphorus is therefore 0.001 to 0.2 mass % in the present embodiment.

<Silicon: 0.01 to 0.3 Mass %>

Silicon is an element having a function of precipitation strengthening when forming compounds with additional elements such as chromium and nickel. A content of silicon less than 0.01 mass % makes the effect insufficient, and a content of silicon more than 0.3 mass % makes it difficult to keep the electrical conductivity at greater than or equal to 50% Y. The content of silicon is therefore 0.01 to 0.3 mass % in the present embodiment.

<Silver: 0.01 to 0.3 Mass %>

Silver is an element having a function of high strengthening when added and solid-solved in copper, and precipitating finely. With a content of silver of less than 0.01 mass %, precipitation hardening cannot be expected and a yield stress is insufficient, and a content of silver more than 0.3 mass % not only results in saturation of the effect but also causes an increase in cost. The content of silver is therefore 0.01 to 0.3 mass % in the present embodiment.

<Nickel: 0.1 to 1.0 Mass %>

Nickel is an element having a function of high strengthening when added and solid-solved in copper, and precipitating finely. With a content of nickel of less than 0.1 mass %, precipitation hardening cannot be expected and a yield stress is insufficient, and with a content of nickel of more than 1.0 mass %, it is difficult to keep the electrical conductivity at greater than or equal to 50%. The content of nickel is therefore 0.1 to 1.0 mass % in the present embodiment.

<Balance: Copper and Inevitable Impurities>

The balance, other than the components described above, is copper and inevitable impurities. The term inevitable impurities herein refers to impurities at a content level at which the impurities are inevitably contained in a manufacturing process. The inevitable impurities can be a factor in decreasing the electrical conductivity depending on contents of the inevitable impurities, and it is thus preferable to suppress to some extent the contents of the inevitable impurities factoring in a decrease in electrical conductivity.

[Method for Manufacturing Conductors]

In a method for manufacturing the above-described conductors, the conductors are manufactured by the steps of [1] melting and casting, [2] hot working, [3] cold working, [4] heat treatment, and [5] finishing. For example, in a case of a slit manufacturing method, the conductors are manufactured by the steps of [1-1] melting and casting, [2-1] hot rolling, [3-1] cold rolling, [4-1] heat treatment, and [5-1] finishing rolling, and slit cutting is performed to obtain a desired width, so as to prepare a plurality of conductors each having cross-sectional area of 0.75 $mm^2$ or smaller, preferably 0.010 $mm^2$ to 0.02 $mm^2$ except for high-current conductors for a heat steering wheel (a heating device for a steering wheel). Note that, a process A and a process B in Examples have common conditions for two processes of [1-1] melting and casting, and [2-1] hot rolling, and have different conditions for the subsequent three processes of [3-1] cold rolling, [4-1] heat treatment, and [5-1] finishing rolling.

[1-1] Melting and Casting

In the melting and casting, an ingot having a thickness of 150 mm to 180 mm is manufactured by adjusting amount of the components so as to prepare the copper alloy composition as described above, and melting the components.

[2-1] Hot Rolling

Next, the ingot produced in the above step is subjected to hot rolling at 600 to 1000° C. to be manufactured into a plate material having a thickness of 10 mm to 20 mm.

[3-1] Cold Rolling

Furthermore, the plate material after hot rolling treatment is subjected to cold rolling so as to be manufactured into a conductor having a thickness of 0.02 mm to 1.2 mm. After the cold-rolling step, any heat treatment can be performed before heat treatment to be described below.

[4-1] Heat Treatment

Next, the conductor is subjected to heat treatment under heat treatment conditions including a heating temperature of 200 to 900° C. and a heating duration of 5 seconds to 4 hours. In the heat treatment at this point, a grain size may preferably be 12 μm or smaller if the heat treatment is for recrystallization, and although specific conditions however differ depending on the type of alloy, heat treatment at 300 to 450° C. for about 30 minutes can control the grain size in a copper-tin-based alloy when sufficient cold working has been performed in the above [3]. In a case where this heat treatment is aging heat treatment, the aging heat treatment preferably causes fine precipitation that gives a grain size of smaller than 10 nm, and although conditions also differ depending on the type of alloy, selecting a proper temperature range of 400 to 500° C. and 2 hours is sufficient for a copper-chromium-based alloy. In a case where the copper alloy is a solid-solution alloy that is subjected to recrystallization, a proper range of a heat treatment condition can be easily selected by varying the heat treatment condition and checking a grain size, and in a case where the copper alloy is a precipitation alloy that needs aging heat treatment, it is possible to similarly vary a heat treatment condition and check the precipitate size, or as an alternative, it is possible to select a heat treatment condition that can maximize a mechanical strength and sufficiently increase an electrical conductivity by precipitation. In a case where the copper alloy is a precipitation alloy, it is possible to purposely select overaging heat treatment, which can provide a high electrical conductivity despite a decrease in strength, as long as a yield stress can be finally controlled within a range defined in the present disclosure.

[5-1] Finishing Rolling

Subsequently, the conductor subjected to the heat treatment is subjected to finishing rolling so as to be manufactured into a conductor having a width of 0.1 mm to 15 mm, and a thickness of 0.02 mm to 0.05 mm. A rolling reduction of the finish rolling (the rate of reduction in thickness) is 12 to 98%. In a material subjected to recrystallization in the above [4], grains of the material are flattened by this finishing rolling, and ratios of lengths/breadths of the grains are made about 1.5 to 15.

[Other Methods for Manufacturing Conductor]

The above-described conductor can be manufactured by manufacturing methods other than the slit manufacturing method described above. For example, in a case of a round-wire rolling technique, the hot rolling and the cold rolling of the above processes of [1-1] to [5-1] are replaced with hot drawing and cold drawing, respectively, so that a conductor is manufactured through processes of [1-2] melting and casting, [2-2] hot drawing, [3-2] cold drawing, [4-2] heat treatment, and [5-2] finishing rolling, and the slit rolling in a final step is dispensed with. Alternatively, cold rolling may be added between the cold drawing and the heat treatment, so that the conductor is manufactured through processes of [1-3] melting and casting, [2-3] hot drawing, [3-3] cold drawing, cold rolling, [4-3] heat treatment, and [5-3] finishing rolling. In a case of a solid-solution alloy, the heat treatment can be performed any plurality of times in the above other manufacturing methods. As seen from the above, methods for manufacturing the conductor are not limited as long as the properties and the like of the conductor are within the ranges described in the present disclosure.

[Method for Manufacturing Flat Cable]

In a method for manufacturing a flat cable according to the present embodiment, a predetermined number of the conductors that have a width-direction cross-sectional area of 0.75 $mm^2$ or smaller, preferably 0.02 $mm^2$ or smaller are prepared, and when the conductors are manufactured through the above steps by the slit manufacturing method, the conductors are subjected to the slit cutting. In addition, in the round-wire rolling technique, conductors in a desired shape (finishing rolled materials) are prepared since the round-wire rolling technique does not need slit cutting. Then, insulating films are disposed on both sides of a principal surface of each of the predetermined number of the conductors, and the above predetermined number of the conductors are sandwiched by a pair of insulating films with an adhesive interposed therebetween, with a tension of 0.3 kgf or higher applied to each of the predetermined number of the conductors. A laminating process is then performed by pressing a laminated body including the predetermined number of the conductors, the adhesive, and the pair of insulating films. In a case of the predetermined number of conductors according to the present embodiment, even when the conductors are sandwiched by the pair of insulating films, with a tension of 0.3 kgf or higher being applied to each of the predetermined number of conductors, a laminate can be formed without plastic deformation occurring in the conductors. In addition, when the flat cable is manufactured in conformity to a predetermined guideline that specifying laminating process conditions, a flat cable having high safety and reliability as specified in the guideline can be provided.

[Properties of Flat Cable and Conductor]

In the flat cable according to the present embodiment, when the bending radius given is within a range of 4 mm to 8 mm, the conductors satisfy $Y \geq 1.2 \times t \times E/(2X-t)$, where X (unit: mm) denotes a bending radius, Y (unit: MPa) denotes a 0.2% yield stress, t (unit: mm) denotes a thickness, E (unit: MPa) denotes a Young's modulus, and the conductors have an electrical conductivity of greater than or equal to 50% IACS. In addition, the above inequality holds for a thickness of the conductors of 0.02 mm to 0.05 mm according to the present disclosure. For example, when the bending radius is 8 mm, the thickness is 0.02 mm, and the Young's modulus is 120000 MPa that is a normal Young's modulus of a copper and a copper alloy, the 0.2% yield stress of the conductors satisfies 180 MPa or higher. With the 0.2% yield stress and the electrical conductivity at values within the respective ranges, it is possible to keep an electrical conductivity that is equivalent to conductivities of conductors of the related art, in such a range that has no influence on a product, and to consider bendability and buckling resistance by not setting a high-strength property, providing a good bending property. Preferably, an elongation is less than 5%. With the elongation within the above range, it is possible to improve a bending property, increasing a lifetime of the conductors even with a smaller radius.

[Property of Rotatable Connector Device]

In the rotatable connector device including the above flat cable, a 0.2% yield stress of the flat cable in a longitudinal direction of the flat cable after 200000 bending movements performed with a bending radius being kept at 8 mm or smaller (hereinafter, also referred to as a residual yield stress) is greater than or equal to 80% of a 0.2% yield stress in the longitudinal direction before the bending movements (hereinafter, also referred to as an initial yield stress). When the residual yield stress of conductors after the bending movements is less than 80% of the initial yield stress, an elasticity that may be desirable for the conductors to maintain shapes of the conductors is lost. Therefore, in the present disclosure, the conductors have an elasticity that may be desirable to maintain the shapes of the conductors in a case where the residual yield stress after the bending movement is greater than or equal to 80%.

EXAMPLES

Hereinafter, examples of the present disclosure will be described in detail.

First, tin, magnesium, chromium, zinc, titanium, zirconium, iron, phosphorus, silicon, silver, and nickel were prepared so as to be at contents shown in Table 1, and ingots that were made of copper alloys (alloys No. 1 to No. 20) having respective alloy compositions and each have a thickness of 150 mm to 180 mm, were manufactured by a casting machine. Next, the ingots were subjected to hot rolling at 600 to 1000° C. so as to be manufactured into plates each having a thickness of 20 mm, and were thereafter subjected to cold rolling.

After undergoing the above common steps, the plates were subjected to aging heat treatment in a process A, as shown in Table 2, at a treatment temperature of any one of 400° C., 425° C., and 450° C., for a treatment time period of either 30 minutes or 2 hours, and were thereafter subjected to finishing rolling at a rolling reduction of 19%, resulting in conductors each having a thickness of 0.035 mm.

In a process B, as shown in Table 3, the plates were subjected to aging heat treatment at a treatment temperature of any one of 400° C., 425° C., and 450° C., for a treatment time period of either 30 minutes or 2 hours, and were thereafter subjected to rolling processing at a rolling reduction of either 90% or 77%, resulting in conductors each having a thickness of 0.035 mm. The thickness of the conductors as finished products was the same in the processes A and B.

Furthermore, in a process C, which was for comparison, as shown in Table 4, the plates subjected to the hot rolling and having a thickness of 20 mm were subjected to cold rolling, resulting in conductors each having a thickness of 0.035 mm, and the conductors were thereafter subjected to aging heat treatment at a treatment temperature of any one of 350° C., 375° C., 400° C., 450° C., 700° C., 750° C., 800° C., and 900° C., for a treatment time period of any one of 15 seconds, 30 minutes, and 2 hours.

For the manufactured conductors, properties including 0.2% yield stress, electrical conductivity (EC), elongation, and bending life, as well as grain size before the finishing rolling were measured by the following method.

(A) 0.2% Yield Stress

A tension test was conducted with test conditions conforming to JIS Z 2241 and a rolling direction taken as a longitudinal direction.

(B) Electrical Conductivity (EC)

As a criterion for electric resistance (or electrical conductivity), an electrical conductivity of a standard annealed soft copper at 20° C. (volume resistivity: $1.7241\times10^{-2}$ μΩm), which is internationally adopted, was determined as 100% IACS. Electrical conductivities of materials are generally known, where a pure copper (tough pitch copper, oxygen-free copper) has an electrical conductivity of EC=100% IACS, and Cu-0.15Sn and Cu-0.3Cr each have an electrical conductivity of EC=about 85% IACS. Here, EC is an abbreviation for "Electrical Conductivity", and IACS stands for "International Annealed Copper Standard".

Meanwhile, conductive properties of the conductors vary depending on manufacture processes. For example, comparing the process A and the process B in the present embodiment, the process B resulted in a relatively degraded conductive property due to a difference in an amount of finishing rolling. As to electric resistances of the materials in the Examples, an electric resistance of greater than or equal to 70% IACS was determined to be very good, "◎", meaning that the conductor played an adequate role in an supposed environment or an equivalent range of the design, an electric resistance of 50 to 70% IACS was determined to be good, "○", meaning that the conductor had a sufficient product property in some usage environments or SRC structures, and an electric resistance less than 50% IACS is determined to be poor, "x", meaning that the conductor was unsuitable.

(C) Elongation

A tension test was conducted with test conditions conforming to JIS Z 2241, in a longitudinal direction of the conductors, and elongations after fracture were measured. When an elongation of a conductor in a measurement result is less than 5%, a lifetime of the conductor can be prolonged, which enables, for example, the range of design to be expanded, and therefore measured values are shown explicitly. By improving a property of elongation, even if an electrical conductivity is sacrificed to some extent and made lower than electrical conductivities of conductors of the related art to some extent, it is possible to further improve the bending property and, depending on a performance balance, the conductor will be a conductor suitable for a flat cable used in a rotatable connector device.

(D) Young's Modulus

As a Young's modulus, use was made of a numeric value (MPa) equivalent to an inclination obtained by dividing a stress variation by a strain variation, within an elasticity range of a stress-strain curve not reaching a 0.2% yield stress, the stress-strain curve being obtained the tension test for the above sections (A) and (C). This numeric value vary depending on processes but more significantly depends on compositions in the present Examples, and thus only representative values are shown in Table 2.

(E) Grain Size Before Finishing Rolling

As to grain size, on cross sections in two directions, i.e., a width direction and a thickness direction, test samples were embedded in a resin, mirror polished, and subjected to intergranular corrosion using an etchant such as a chromic acid, such that the test samples are in a state where a grain size can be sufficiently determined when observed with an optical microscope or an electron microscope, and the grain size was measured in conformity with the intercept method of JIS H 0501. The number of measurements were 30 to 100, and an average diameter value per grain was determined.

(F) Bending Life

Using an FPC bending tester (from Ueshima Seisakusho Co., Ltd., apparatus name: FT-2130), on a sample fixing plate and a movable plate, after cutting a conductor into a length of 100 mm, two of the cut conductors were bridged so as to be energizable with one end being adhered to a movable plate side and another end being bent in a vertical direction with a desired diameter. The other end was further fixed on a fixing plate side, both free ends were connected to the measuring instrument, and the bending life was determined. When one of the two cut conductors is broken, it becomes impossible to measure voltage, and therefore a time point of the breakage was determined as a lifetime. The test conditions included a test temperature of 20 to 85° C., a bending radius X of radii of 4 mm to 8 mm (7.5 mm, 6.3 mm, 5.5 mm, and 4.7 mm), a stroke of ±13 mm, and a rotation speed of 180 rpm. A case where the number of bendings was 300000 or more at a time when a voltage became impossible to measure was determined to be good, "○", meaning that a fatigue property desirable for a rotatable connector is satisfied, and a case where the number of bendings was less than 300000 was determined to be poor, "x". Results of the measurement and evaluations by the above method are shown in Tables 2 to 4.

TABLE 1

| ALLOY | ALLOY COMPOSITION (mass %) | | | | | | | | | | |
|---|---|---|---|---|---|---|---|---|---|---|---|
| No. | Sn | Mg | Cr | Zn | Ti | Zr | Fe | P | Si | Ag | Ni |
| 1 | 0.15 | | | | | | | | | | |
| 2 | 0.3 | | | | | | | | | | |
| 3 | 0.7 | | | | | | | | | | |
| 4 | 0.25 | | 0.3 | 0.15 | | | | | | | |
| 5 | | 0.1 | 0.3 | | | | | | | | |
| 6 | 0.8 | | 0.3 | 0.5 | | | | | | | |
| 7 | | | | | | 0.1 | | | | | |
| 8 | | | 0.3 | | | 0.1 | | | 0.02 | | |
| 9 | | | 0.3 | | 0.1 | | | | 0.02 | | |
| 10 | | | 0.5 | | 0.06 | | 0.08 | | 0.03 | 0.2 | |
| 11 | | | | 0.12 | | | 2.3 | 0.03 | | | |
| 12 | | 0.7 | | | | | | 0.005 | | | |
| 13 | | | | 0.1 | | | 0.1 | 0.13 | | | 0.7 |
| 14 | | | | | | | 2.25 | | 0.02 | | |
| 15 | | | | | | | 0.1 | 0.003 | | | |
| 16 | | 0.13 | | | | | 022 | 0.1 | | | |
| 17 | 0.07 | | | | | | 0.2 | 0.06 | | | 0.15 |
| 18 | | | | | | | | | | | |
| 19 | *10* | | | | | | | | | | |
| 20 | | | | *30* | | | | | | | |

Note 1)

Underlined and italic values in the table indicate that the values are out of the respective ranges of the present disclosure.

Note 2)

No. 18 shows a pure copper contains no added elements but Cu.

TABLE 2

| | PROCESS A | | | | | | | |
|---|---|---|---|---|---|---|---|---|
| AL-LOY NO. | DETAILED MANUFACTURING METHOD | ROLLING REDUCTION IN FINISHING ROLLING (%) | 0.2% YIELD STRESS (MPa) | CONDUC-TIVITY (% IACS) | ELONGA-TION (%) | YOUNG'S MODULUS (MPa) | GRAIN SIZE BEFORE FINISHING ROLLING (μm) | CRITICAL BENDING RADIUS (mm) |
| 1 | COLD ROLLING INTO 0.043 mm THICKNESS → HEAT TREATMENT AT 400° C. FOR 30 min → FINISHING ROLLING INTO 0.035 mm THICKNESS | 19 | 400 | 85 | 25 | 118000 | 7 | 6.2 |
| 2 | COLD ROLLING INTO 0.043 mm THICKNESS → HEAT TREATMENT AT 400° C. FOR 30 min → FINISHING ROLLING INTO 0.035 mm THICKNESS | 19 | 450 | 75 | 22 | 116000 | 5 | 5.4 |
| 3 | COLD ROLLING INTO 0.043 mm THICKNESS → HEAT TREATMENT AT 400° C. FOR 30 min → FINISHING ROLLING INTO 0.035 mm THICKNESS | 19 | 470 | 60 | 20 | 115000 | 4 | 5.2 |
| 4 | COLD ROLLING INTO 0.043 mm THICKNESS → HEAT TREATMENT AT 400° C. FOR 30 min → FINISHING ROLLING INTO 0.035 mm THICKNESS | 19 | 550 | 75 | 20 | 140000 | 3 | 5.4 |

TABLE 2-continued

| | | | | | | | | |
|---|---|---|---|---|---|---|---|---|
| 5 | COLD ROLLING INTO 0.043 mm THICKNESS → HEAT TREATMENT AT 400° C. FOR 30 min → FINISHING ROLLING INTO 0.035 mm THICKNESS | 19 | 550 | 65 | 20 | 140000 | — | 5.4 |
| 6 | COLD ROLLING INTO 0.043 mm THICKNESS → HEAT TREATMENT AT 400° C. FOR 30 min → FINISHING ROLLING INTO 0.035 mm THICKNESS | 19 | 540 | 55 | 20 | 140000 | — | 5.5 |
| 7 | COLD ROLLING INTO 0.043 mm THICKNESS → HEAT TREATMENT AT 400° C. FOR 30 min → FINISHING ROLLING INTO 0.035 mm THICKNESS | 19 | 530 | 90 | 20 | 120000 | — | 4.8 |
| 8 | COLD ROLLING INTO 0.043 mm THICKNESS → HEAT TREATMENT AT 400° C. FOR 30 min → FINISHING ROLLING INTO 0.035 mm THICKNESS | 19 | 545 | 78 | 20 | 140000 | — | 5.4 |
| 9 | COLD ROLLING INTO 0.043 mm THICKNESS → HEAT TREATMENT AT 400° C. FOR 30 min → FINISHING ROLLING INTO 0.035 mm THICKNESS | 19 | 540 | 78 | 20 | 140000 | — | 5.5 |
| 10 | COLD ROLLING INTO 0.043 mm THICKNESS → HEAT TREATMENT AT 400° C. FOR 30 min → FINISHING ROLLING INTO 0.035 mm THICKNESS | 19 | 540 | 78 | 20 | 140000 | — | 5.5 |
| 11 | COLD ROLLING INTO 0.043 mm THICKNESS → HEAT TREATMENT AT 400° C. FOR 30 min → FINISHING ROLLING INTO 0.035 mm THICKNESS | 19 | 530 | 60 | 20 | 121000 | — | 4.8 |
| 12 | COLD ROLLING INTO 0.043 mm THICKNESS → HEAT TREATMENT AT 400° C. FOR 30 min → FINISHING ROLLING INTO 0.035 mm THICKNESS | 19 | 480 | 60 | 21 | 125000 | 10 | 5.5 |
| 13 | COLD ROLLING INTO 0.043 mm THICKNESS → HEAT TREATMENT AT 400° C. FOR 30 min → FINISHING ROLLING INTO 0.035 mm THICKNESS | 19 | 460 | 75 | 22 | 120000 | 10 | 5.5 |
| 14 | COLD ROLLING INTO 0.043 mm THICKNESS → HEAT TREATMENT AT 400° C. FOR 30 min → FINISHING ROLLING INTO 0.035 mm THICKNESS | 19 | 550 | 60 | 20 | 121000 | — | 4.6 |
| 15 | COLD ROLLING INTO 0.043 mm THICKNESS → HEAT TREATMENT AT 400° C. FOR 30 min → FINISHING ROLLING INTO 0.035 mm THICKNESS | 19 | 430 | 90 | 21 | 120000 | 10 | 5.9 |
| 16 | COLD ROLLING INTO 0.043 mm THICKNESS → HEAT TREATMENT AT 400° C. FOR 30 min → FINISHING ROLLING INTO 0.035 mm THICKNESS | 19 | 460 | 80 | 22 | 120000 | 8 | 5.5 |
| 17 | COLD ROLLING INTO 0.043 mm THICKNESS → HEAT TREATMENT AT 400° C. FOR 30 min → FINISHING ROLLING INTO 0.035 mm THICKNESS | 19 | 470 | 78 | 22 | 120000 | 10 | 5.4 |

TABLE 2-continued

| | | | | | | | | |
|---|---|---|---|---|---|---|---|---|
| 18 | COLD ROLLING INTO 0.043 mm THICKNESS → HEAT TREATMENT AT 400° C. FOR 30 min → FINISHING ROLLING INTO 0.035 mm THICKNESS | 19 | *320* | 99 | 18 | 120000 | 12 | 7.9 |
| 19 | COLD ROLLING INTO 0.043 mm THICKNESS → HEAT TREATMENT AT 400° C. FOR 30 min → FINISHING ROLLING INTO 0.035 mm THICKNESS | 19 | 720 | *10* | 8 | 110000 | 4 | 3.2 |
| 20 | COLD ROLLING INTO 0.043 mm THICKNESS → HEAT TREATMENT AT 400° C. FOR 30 min → FINISHING ROLLING INTO 0.035 mm THICKNESS | 19 | 680 | *30* | 7 | 110000 | 4 | 3.4 |

| | BENDING LIFE FOR EACH BENDING RADIUS | | | | | APPLIED | DEVIATION IN PITCH BETWEEN CONDUCTORS | CHANGE IN CROSS-SECTIONAL AREA OF CONDUCTOR | RESIDUAL YIELD STRESS OF CONDUCTOR |
|---|---|---|---|---|---|---|---|---|---|
| ALLOY NO. | 7.5 (mm) | 6.3 (mm) | 5.5 (mm) | 4.7 (mm) | ELECTRIC RESISTANCE | TENSION (kgf) | IN FORMING LAMINATE | IN FORMING LAMINATE | AFTER BENDING TEST |
| 1 | ○ | ○ | x | x | ○ | 0.35 | ○ | ○ | ○ |
| 2 | ○ | ○ | ○ | x | ○ | 0.35 | ○ | ○ | ○ |
| 3 | ○ | ○ | ○ | x | ○ | 0.35 | ○ | ○ | ○ |
| 4 | ○ | ○ | ○ | x | ○ | 0.35 | ○ | ○ | ○ |
| 5 | ○ | ○ | ○ | x | ○ | 0.35 | ○ | ○ | ○ |
| 6 | ○ | ○ | ○ | x | ○ | 0.35 | ○ | ○ | ○ |
| 7 | ○ | ○ | ○ | x | ○ | 0.35 | ○ | ○ | ○ |
| 8 | ○ | ○ | ○ | x | ○ | 0.35 | ○ | ○ | ○ |
| 9 | ○ | ○ | ○ | x | ○ | 0.35 | ○ | ○ | ○ |
| 10 | ○ | ○ | ○ | x | ○ | 0.35 | ○ | ○ | ○ |
| 11 | ○ | ○ | ○ | x | ○ | 0.35 | ○ | ○ | ○ |
| 12 | ○ | ○ | ○ | x | ○ | 0.35 | ○ | ○ | ○ |
| 13 | ○ | ○ | ○ | ○ | ○ | 0.35 | ○ | ○ | ○ |
| 14 | ○ | ○ | ○ | ○ | ○ | 0.35 | ○ | ○ | ○ |
| 15 | ○ | ○ | x | x | ○ | 0.35 | ○ | ○ | ○ |
| 16 | ○ | ○ | ○ | x | ○ | 0.35 | ○ | ○ | ○ |
| 17 | ○ | ○ | ○ | x | ○ | 0.35 | ○ | ○ | ○ |
| 18 | x | x | x | x | ○ | 0.35 | ○ | ○ | — |
| 19 | ○ | ○ | ○ | ○ | x | 0.35 | ○ | ○ | ○ |
| 20 | ○ | ○ | ○ | ○ | x | 0.35 | ○ | ○ | ○ |

Note 1)

Underlined and italic values in the table indicate that the values are out of the respective ranges of the present disclosure Note 2)

The symbol '—' in the table indicatets that the measurement was impossible because the microstructure was a worked micrsctruture (heavily rolled microstrucutre)

TABLE 3

| | PROCESS B | | | | | | | BENDING |
|---|---|---|---|---|---|---|---|---|
| ALLOY NO. | DETAILED MANUFACTURING METHOD | ROLLING REDUCTION IN FINISHING ROLLING (%) | 0.2% YIELD STRESS (MPa) | CONDUC-TIVITY (% IACS) | ELONGA-TION (%) | GRAIN SIZE BEFORE FINISHING ROLLING (μm) | CRITICAL BENDING RADIUS (mm) | LIFE FOR EACH BENDING RADIUS 7.5 (mm) |
| 1 | COLD ROLLING INTO 0.35 mm THICKNESS → HEAT TREATMENT AT 400° C. FOR 30 min → FINISHING ROLLING INTO 0.035 mm THICKNESS | 90 | 510 | 80 | 3 | 7 | 4.9 | ○ |
| 2 | COLD ROLLING INTO 0.35 mm THICKNESS → HEAT TREATMENT AT 400° C. FOR 30 min → FINISHING ROLLING INTO 0.035 mm THICKNESS | 90 | 550 | 70 | 2 | 5 | 4.4 | ○ |

TABLE 3-continued

| | | | | | | | | |
|---|---|---|---|---|---|---|---|---|
| 3 | COLD ROLLING INTO 0.35 mm THICKNESS → HEAT TREATMENT AT 400 C. FOR 30 min → FINISHING ROLLING INTO 0.035 mm THICKNESS | 90 | 590 | 58 | 1 | 4 | 4.1 | ○ |
| 4 | COLD ROLLING INTO 0.15 mm THICKNESS → HEAT TREATMENT AT 400° C. FOR 30 min → FINISHING ROLLING INTO 0.035 mm THICKNESS | 77 | 640 | 66 | 1 | 3 | 4.6 | ○ |
| 5 | COLD ROLLING INTO 0.15 mm THICKNESS → HEAT TREATMENT AT 400° C. FOR 30 min → FINISHING ROLLING INTO 0.035 mm THICKNESS | 77 | 635 | 72 | 1 | — | 4.6 | ○ |
| 6 | COLD ROLLING INTO 0.15 mm THICKNESS → HEAT TREATMENT AT 400° C. FOR 30 min → FINISHING ROLLING INTO 0.035 mm THICKNESS | 77 | 690 | 50 | 1 | — | 4.3 | ○ |
| 7 | COLD ROLLING INTO 0.35 mm THICKNESS → HEAT TREATMENT AT 400° C. FOR 30 min → FINISHING ROLLING INTO 0.035 mm THICKNESS | 90 | 550 | 85 | 2 | — | 4.6 | ○ |
| 8 | COLD ROLLING INTO 0.15 mm THICKNESS → HEAT TREATMENT AT 400° C. FOR 30 min → FINISHING ROLLING INTO 0.035 mm THICKNESS | 77 | 640 | 72 | 2 | — | 4.6 | ○ |
| 9 | COLD ROLLING INTO 0.15 mm THICKNESS → HEAT TREATMENT AT 400° C. FOR 30 min → FINISHING ROLLING INTO 0.035 mm THICKNESS | 77 | 640 | 72 | 1 | — | 4.6 | ○ |
| 10 | COLD ROLLING INTO 0.15 mm THICKNESS → HEAT TREATMENT AT 400° C. FOR 30 min → FINISHING ROLLING INTO 0.035 mm THICKNESS | 77 | 650 | 72 | 1 | — | 4.5 | ○ |
| 11 | COLD ROLLING INTO 0.35 mm THICKNESS → HEAT TREATMENT AT 400° C. FOR 30 min → FINISHING ROLLING INTO 0.035 mm THICKNESS | 90 | 650 | 52 | 1 | — | 3.9 | ○ |
| 12 | COLD ROLLING INTO 0.35 mm THICKNESS → HEAT TREATMENT AT 400° C. FOR 30 min → FINISHING ROLLING INTO 0.035 mm THICKNESS | 90 | 670 | 55 | 1 | 10 | 3.9 | ○ |
| 13 | COLD ROLLING INTO 0.35 mm THICKNESS → HEAT TREATMENT AT 400° C. FOR 30 min → FINISHING ROLLING INTO 0.035 mm THICKNESS | 90 | 600 | 65 | 1 | 10 | 4.2 | ○ |
| 14 | COLD ROLLING INTO 0.35 mm THICKNESS → HEAT TREATMENT AT 400° C. FOR 30 min → FINISHING ROLLING INTO 0.035 mm THICKNESS | 90 | 650 | 55 | 1 | — | 3.9 | ○ |
| 15 | COLD ROLLING INTO 0.35 mm THICKNESS → HEAT TREATMENT AT 400° C. FOR 30 min → FINISHING ROLLING INTO 0.035 mm THICKNESS | 90 | 530 | 82 | 2 | 10 | 4.8 | ○ |

TABLE 3-continued

| | | | | | | | | |
|---|---|---|---|---|---|---|---|---|
| 16 | COLD ROLLING INTO 0.35 mm THICKNESS → HEAT TREATMENT AT 400° C. FOR 30 min → FINISHING ROLLING INTO 0.035 mm THICKNESS | 90 | 520 | 75 | 2 | 8 | 4.9 | ○ |
| 17 | COLD ROLLING INTO 0.35 mm THICKNESS → HEAT TREATMENT AT 400° C. FOR 30 min → FINISHING ROLLING INTO 0.035 mm THICKNESS | 90 | 570 | 70 | 2 | 12 | 4.4 | ○ |

| | BENDING LIFE FOR EACH BENDING RADIUS | | | | APPLIED | DEVIATION IN PITCH BETWEEN CONDUCTORS | CHANGE IN CROSS-SECTIONAL AREA OF CONDUCTOR | RESIDUAL YIELD STRESS OF CONDUCTOR AFTER |
|---|---|---|---|---|---|---|---|---|
| ALLOY NO. | 6.3 (mm) | 5.5 (mm) | 4.7 (mm) | ELECTRIC RESISTANCE | TENSION (kgf) | IN FORMING LAMINATE | IN FORMING LAMINATE | BENDING TEST |
| 1 | ○ | ○ | x | ◎ | 0.35 | ○ | ○ | ○ |
| 2 | ○ | ○ | ○ | ◎ | 0.35 | ○ | ○ | ○ |
| 3 | ○ | ○ | ○ | ○ | 0.35 | ○ | ○ | ○ |
| 4 | ○ | ○ | ○ | ○ | 0.35 | ○ | ○ | ○ |
| 5 | ○ | ○ | ○ | ◎ | 0.35 | ○ | ○ | ○ |
| 6 | ○ | ○ | ○ | ○ | 0.35 | ○ | ○ | ○ |
| 7 | ○ | ○ | ○ | ◎ | 0.35 | ○ | ○ | ○ |
| 8 | ○ | ○ | ○ | ◎ | 0.35 | ○ | ○ | ○ |
| 9 | ○ | ○ | ○ | ◎ | 0.35 | ○ | ○ | ○ |
| 10 | ○ | ○ | ○ | ◎ | 0.35 | ○ | ○ | ○ |
| 11 | ○ | ○ | ○ | ○ | 0.35 | ○ | ○ | ○ |
| 12 | ○ | ○ | ○ | ○ | 0.35 | ○ | ○ | ○ |
| 13 | ○ | ○ | ○ | ○ | 0.35 | ○ | ○ | ○ |
| 14 | ○ | ○ | ○ | ○ | 0.35 | ○ | ○ | ○ |
| 15 | ○ | ○ | x | ◎ | 0.35 | ○ | ○ | ○ |
| 16 | ○ | ○ | x | ◎ | 0.35 | ○ | ○ | ○ |
| 17 | ○ | ○ | ○ | ◎ | 0.35 | ○ | ○ | ○ |

Note)
The symbol "—" in the table indicates that the measurement was impossible because the microstructure was a worked microstructure (heavily rolled microstructure).

TABLE 4

| | PROCESS C | | | | CRITICAL | | BENDING LIFE FOR EACH | |
|---|---|---|---|---|---|---|---|---|
| | DETAILED | 0.2% YIELD | CONDUC- | ELONGA- | BENDING | GRAIN | BENDING RADIUS | |
| ALLOY NO. | MANUFACTURING METHOD | STRESS (MPa) | TIVITY (% IACS) | TION (%) | RADIUS (mm) | SIZE (μm) | 7.5 (mm) | 6.3 (mm) |
| 1 | COLD ROLLING INTO 0.035 mm THICKNESS → HEAT TREATMENT AT 350° C. FOR 30 min | *150* | 86 | 35 | 16.5 | 7 | ○ | ○ |
| 2 | COLD ROLLING INTO 0.035 mm THICKNESS → HEAT TREATMENT AT 350° C. FOR 20 min | *180* | 77 | 33 | 13.6 | 6 | ○ | ○ |
| 3 | COLD ROLLING INTO 0.035 mm THICKNESS → HEAT TREATMENT AT 375° C. FOR 30 min | *200* | 65 | 32 | 12.1 | 5 | ○ | ○ |
| 4 | COLD ROLLING INTO 0.035 mm THICKNESS → HEAT TREATMENT AT 200° C. FOR 2 h | *650* | *45* | 5 | 4.5 | — | ○ | ○ |
| 5 | COLD ROLLING INTO 0.035 mm THICKNESS → HEAT TREATMENT AT 900° C. FOR 15 s | *200* | *40* | 25 | 14.7 | 12 | ○ | ○ |
| 6 | COLD ROLLING INTO 0.035 mm THICKNESS → HEAT TREATMENT AT 750° C. FOR 2 h | *250* | *45* | 25 | 11.8 | 20 | ○ | x |

TABLE 4-continued

| | | | | | | | | |
|---|---|---|---|---|---|---|---|---|
| 7 | COLD ROLLING INTO 0.035 mm THICKNESS → HEAT TREATMENT AT 800° C. FOR 2 h | *130* | 70 | 25 | 19.4 | 35 | ○ | x |
| 8 | COLD ROLLING INTO 0.035 mm THICKNESS → HEAT TREATMENT AT 900° C. FOR 5 s | *250* | *45* | 20 | 11.8 | 15 | ○ | ○ |
| 9 | COLD ROLLING INTO 0.035 mm THICKNESS → HEAT TREATMENT AT 750° C. FOR 2 h | *230* | *40* | 25 | 12.8 | 25 | ○ | x |
| 10 | COLD ROLLING INTO 0.035 mm THICKNESS → HEAT TREATMENT AT 750° C. FOR 2 h | *260* | *36* | 25 | 11.3 | 15 | ○ | x |
| 11 | COLD ROLLING INTO 0.035 mm THICKNESS → HEAT TREATMENT AT 800° C. FOR 2 h | *150* | *35* | 25 | 17.0 | 35 | ○ | x |
| 12 | COLD ROLLING INTO 0.035 mm THICKNESS → HEAT TREATMENT AT 450° C. FOR 30 min | *200* | 82 | 15 | 13.1 | 15 | ○ | ○ |
| 13 | COLD ROLLING INTO 0.035 mm THICKNESS → HEAT TREATMENT AT 400° C. FOR 30 min | *150* | 77 | 33 | 16.8 | 10 | ○ | ○ |
| 14 | COLD ROLLING INTO 0.035 mm THICKNESS → HEAT TREATMENT AT 750° C. FOR 2 h | *140* | *46* | 30 | 18.2 | 35 | x | x |
| 15 | COLD ROLLING INTO 0.035 mm THICKNESS → HEAT TREATMENT AT 400° C. FOR 30 min | *150* | 91 | 35 | 16.8 | 12. | ○ | ○ |
| 16 | COLD ROLLING INTO 0.035 mm THICKNESS → HEAT TREATMENT AT 375° C. FOR 30 min | *150* | 91 | 33 | 16.8 | 7 | ○ | ○ |
| 17 | COLD ROLLING INTO 0.035 mm THICKNESS → HEAT TREATMENT AT 700° C. FOR 2 h | *180* | 80 | 30 | 14.0 | 35 | x | x |

| ALLOY NO. | BENDING LIFE FOR EACH BENDING RADIUS 5.5 (mm) | BENDING LIFE FOR EACH BENDING RADIUS 4.7 (mm) | ELECTRIC RESISTANCE | APPLIED TENSION (kgf) | DEVIATION IN PITCH BETWEEN CONDUCTORS IN FORMING LAMINATE | CHANGE IN CROSS-SECTIONAL AREA OF CONDUCTOR IN FORMING LAMINATE | RESIDUAL YIELD STRESS OF CONDUCTOR AFTER BENDING TEST |
|---|---|---|---|---|---|---|---|
| 1 | x | x | ◎ | .35 | ○ | x | ○ |
| 2 | x | x | ◎ | .35 | ○ | x | ○ |
| 3 | x | x | ○ | .35 | ○ | x | ○ |
| 4 | ○ | ○ | x | .35 | ○ | ○ | ○ |
| 5 | x | x | x | .35 | ○ | x | ○ |
| 6 | x | x | x | .35 | ○ | ○ | ○ |
| 7 | x | x | ◎ | .35 | ○ | x | ○ |
| 8 | x | x | x | .35 | ○ | ○ | ○ |
| 9 | x | x | x | .35 | ○ | x | ○ |
| 10 | x | x | x | .35 | ○ | ○ | ○ |
| 11 | x | x | x | .35 | ○ | x | ○ |
| 12 | x | x | ○ | .35 | ○ | x | ○ |
| 13 | x | x | ○ | ..20 | x | ○ | ○ |
| 14 | x | x | x | .20 | x | ○ | ○ |
| 15 | x | x | ◎ | .35 | ○ | x | ○ |
| 16 | x | x | ◎ | .35 | ○ | x | ○ |
| 17 | x | x | ◎ | .35 | ○ | x | ○ |

Note 1)
Underline and italic values in the table indicate that the values are out of the respective ranges of the present disclosure.
Note 2)
The symbol "—" in the table indicates that the measurement was impossible because the microstructure was a worked microstructure (heavily rolled microstructure).

According to the results shown in Tables 2 to 4, in each of Alloys No. 1 to No. 17, the conductors were manufactured by being subjected to the process A or the process B (Table 2 and Table 3), thus resulting in a yield stress that provides a sufficient lifetime for a desired radius, and an electrical conductivity within a range of 50 to 98% IACS. In particular, the process B resulted in an elongation of less than 5%, which is a preferable range.

However, in Alloys No. 1 to No. 17, one or both of the 0.2% yield stress and the electrical conductivity of the conductor that was subjected to the process C during manufacturing (Table 4) was/were out of the respective ranges of to the present disclosure.

In Alloy No. 18, the 0.2% yield stress of the conductor that was subjected to the process A during manufacturing (Table 2), was out of the range of to the present disclosure.

In each of Alloy Nos. 19 and 20, the conductor that was subjected to the process A during manufacturing had a high yield stress that is sufficient for lifetime specification, but had an electrical conductivity that was out of the range of to the present disclosure. In addition, the conductor that was subjected to the process B or C resulted similarly. This is because the content of Sn or Zn in the alloy composition exceeded the upper limit of the range of the present disclosure.

Next, conductors in inventive examples that were made of alloys shown by Alloy Nos. in Table 1 and manufactured by the processes A, B, and C (Table 2, Table 3, and Table 4) were each sandwiched with composite materials made of a PET plastic and an adhesive (from Riken Technos Corporation, flexible flat cable for airbag (insulating films), resin thickness of 25 μm, adhesive thickness of 20 μm) while being given a tension of 0.35 kgf or 0.2 kgf, each subjected to a laminating process by pressing the conductor from both sides, to be manufactured into a flat cable. Conditions of the laminating process included a pressing temperature of 165° C., a pressing time period of 3 minutes, and a pressing pressure of 0.5 MPa.

In addition, combining Alloy Nos. 18, 19, and 20 shown in Table 1 and the process A (Table 2), flat cables were manufactured in a manner similar to the above.

Next, in each of Alloys No. 1 to No. 17 and Alloys No. 18 to No. 20, pitch deviations between conductors in forming the laminate, changes in cross-sectional areas of the conductors in forming the laminate, and residual yield stresses of the conductors after a bending test were observed and measured by the following method. It should be noted that, in a flat cable before the bending test (initial product), an electrical conductivity of a wide strip before subjected to slit formation was measured by a four-terminal method, thereafter, in the flat cable after the bending test, an electrical conductivity of a wide strip (12.75 mm) was measured, under an identical bending test environment, and it was confirmed that there was no change in electrical conductivity before and after the bending test.

(G) Determination of Pitch Deviations Between Conductors in Forming Laminate

A pitch between conductors of a laminate was at 0.2 mm to 1 mm, and the pitch between conductors before the laminating process and the pitch between conductors after the laminating process were compared. A case where a deviation in the pitch between conductors was less than 1/10 was determined to be good, "○", and a case where the deviation was 1/10 or more was determined to be poor, "x". The reason why the deviation in the pitch between conductors in forming the laminate was selected as an evaluation item is that a deviation of 1/10 or more of the pitch between conductors caused a slack to occur in a conductor due to a poor tension in forming the laminate. A pitch deviation between conductors in a laminate becomes a cause of occurrence of a gap between conductors and resin, thus decreasing a bending life, and becomes a cause of a breakage or a reduction in cross-sectional area in manufacturing the laminate if there is a change in applied tension.

(H) Change in Cross-Sectional Area of Conductor in Forming Laminate

A change in a cross-sectional area of a conductor in forming the laminate was checked by measuring an electric resistance across a cable having a length that is employed in a rotatable connector device, and a case where there was no change in resistance in the order of magnitude of the first decimal place or smaller before and after forming the laminate (in Ω) was determined to be good, "○", meaning that the cross-sectional area was maintained, and a case where there was the change in resistance was determined to be poor, "x". In addition to the change in resistance, a case where there was a portion at which a thickness was decreased by 3 μm or more, or a case where there was a portion at which a width was decreased by 0.05 mm or more, was determined to be poor, "x". The thickness or the width was measured on an image that was enlarged under an optical microscope.

(I) Measurement of Residual Yield Stress of Conductor after Bending Test

Using an FPC bending tester (from Ueshima Seisakusho Co., Ltd., apparatus name: FT-2130), the bending test was conducted in such a manner that a test piece obtained by cutting a flat cable into a length of 150 mm was fixed on a sample fixing plate and a movable plate, and the movable plate was moved by a motor unit. The test conditions included a test temperature of 20 to 85° C., a bending radius X of radii of 4 mm to 8 mm, a stroke of ±13 mm, and a rotation speed of 180 rpm, and under the same conditions, the test was conducted 200000 times. After bending test, a test material was taken out, a laminate was dissolved using a cresol. A case where a 0.2% yield stress of a conductor in a longitudinal direction of the conductor after 200000 of the bending movements that are performed with a bending radius X kept within the above range (a residual yield stress) is greater than or equal to 80% of a 0.2% yield stress in the longitudinal direction before the bending test (an initial yield stress) was determined to be good, "○", meaning that an elasticity that may be desired for maintaining a shape of the conductor was retained, and a case where the 0.2% yield stress of the conductor in the longitudinal direction after 200000 of the bending movements is less than 80% of the initial yield stress was determined to be poor, "x", meaning that the elasticity that may be desired for maintaining the shape was lost.

Results of the measurement and determinations by the above method are shown in Tables 2 to 4.

According to the results shown in Table 2, in each of Alloys No. 1 to No. 17, alloy components were within the ranges according to the present disclosure and by being subjected to the process A, both of the 0.2% yield stress and the electrical conductivity were good. In addition, by being subjected to the process A, the flat cable was good in bending life, electric resistance, deviation in pitch between conductors in forming the laminate, changes in cross-sectional areas of the conductors in forming the laminate, and residual yield stresses of the conductor after the bending test. In particular, it is understood that, for at least bending radii of 6.3 mm and 7.5 mm within the range of 4 mm to 8 mm, a fatigue property (bending life) that may be desirable for a flat cable of a rotatable connector device was sufficiently satisfied. Critical bending radius shown in Tables refers to a calculation value calculated from the 0.2% yield stress, the Young's modulus, and the thickness t using the following formula (1).

$$X=(1.2\times E/Y+1)\times t/2 \quad (1),$$

where

X denotes the critical bending radius (unit: mm),

E denotes the Young's modulus (unit: MPa),

Y denotes the 0.2% yield stress (unit: MPa), and t denotes the thickness (unit: mm).

According to a correlation between experimental results and calculation values of the critical bending radius, it can be confirmed that the critical bending radius calculated using the above formula (1) serves as an index for checking whether a bending life of a flat cable is sufficient. Therefore, if a more severe bending radius may be desirable within the range of bending radius of 4 mm to 8 mm, the critical bending radius is calculated from the 0.2% yield stress, the Young's modulus, and the thickness using the above formula (1), and based on the calculated critical bending radius, an appropriate alloy and process can be selected. In addition, a bending radius greater than or equal to a calculation value obtained from the above formula (1) makes a bending life of a flat cable better.

Furthermore, the above formula (1) is rearranged to isolate Y, so as to be converted into the following formula.

$$Y=1.2\times t\times E/(2X-t) \quad (2)$$

That is, when a value of a minimum bending radius assumed based on a specific bending radius according to specifications and the like is known, use of the above formula (2) with the minimum bending radius regarded as the critical bending radius and determination of the Young's modulus and the thickness allow a value of the 0.2% yield stress providing a sufficient fatigue property (bending life) at the critical bending radius to be determined. In addition, a flat cable having a 0.2% yield stress higher than the calculation value obtained from the above formula (2) provides a better bending life.

In addition, referring to the results shown in Table 2, in Alloys No. 1 to No. 17, it can be seen that by being subjected to the process A, the deviation in pitch between conductors in forming the laminate, the changes in cross-sectional areas of the conductors in forming the laminate, and the residual yield stresses of the conductor after the bending test are all good.

In Alloy No. 18, where an alloy component was out of the range of the present disclosure, the bending life was poor for bending radii of 7.5 mm, 6.3 mm, 5.5 mm, and 4.7 mm. In addition, the residual yield stress of the conductor after the bending test was less than 80% of the initial yield stress, meaning the material strength was insufficient. This is because the alloy composition was out of the range of the present disclosure, and it was not possible to inhibit grain coarsening in the bending test, with the result that an effect of hardening by introduced strain and an effect of hardening by grain refining were both lost.

In addition, in Alloys No. 19 and 20, where alloy components were out of the range of the present disclosure, the electrical conductivity was out of the range according to the present disclosure, as described above.

In addition, referring to the results shown in Table 3, it can be seen that, in each of Alloys No. 1 to No. 17, the alloy that was subjected to the process B that makes the elongation less than 5% was good in bending life even for a more sever bending radius in comparison with a case where the alloy was manufactured through the process A, and provides a particularly preferable property.

The results shown in Table 4 are results of prototypes that were subjected to the process C, which is unsuitable. In each of Alloys No. 1 to No. 17, one or both of the 0.2% yield stress and the electrical conductivity of the conductor that was subjected to an inappropriate process was/were out of the respective ranges of the present disclosure. In addition, for example, even when the tension was decreased from 0.35 kgf to 0.20 kgf as in Alloys No. 13 and No. 14 in order to prevent a decrease in cross-sectional area due to an insufficient yield stress, a pitch deviation between conductors in forming the laminate occurred, and thus not all evaluation items could be satisfy. It is noted that, when the inequality according to the present disclosure is calculated using a bending radius of 8 mm, a thickness of 0.035 mm, and a normal Young's modulus of 120000 MPa, which are conditions for minimizing the 0.2% yield stress, a range of 0.2% yield stress in the present disclosure is 315.7 MPa or higher, but soft coppers often have yield stresses that is out of the range of the inequality of the present disclosure, and can be assumed not to satisfy the present inequality.

What is claimed is:

1. A flat cable comprising: a predetermined number of conductors; a pair of insulating films disposed in such a manner as to sandwich the predetermined number of conductors; and an adhesive layer provided between the pair of insulating films, the conductors each comprising one or more of 0.1 to 0.8 mass % of tin, 0.05 to 0.8 mass % of magnesium, 0.01 to 0.5 mass % of chromium, 0.1 to 5.0 mass % of zinc, 0.02 to 0.3 mass % of titanium, 0.01 to 0.2 mass % of zirconium, 0.01 to 3.0 mass % of iron, 0.001 to 0.2 mass % of phosphorus, 0.01 to 0.3 mass % of silicon, 0.01 to 0.3 mass % of silver, and 0.1 to 1.0 mass % of nickel, with a balance comprising copper and inevitable impurities, and satisfying $Y\geq 1.2\times t\times E/(2X-t)$ within a range of bending radius of 4 mm to 8 mm, where X (mm) denotes bending radius, Y (MPa) denotes 0.2% yield stress, t (mm) denotes thickness, and E (MPa) denotes Young's modulus, the conductors each having an electrical conductivity of greater than or equal to 50% IACS, the conductors each having a width of 0.1 mm to 15 mm and a thickness of 0.02 mm to 0.05 mm.

2. The flat cable according to claim 1, wherein the flat cable is provided with a folded-back portion at which the flat cable is bent and folded back, the folded-back portion being at a middle section of the flat cable in a longitudinal direction of the flat cable, the flat cable is wound up or rewound with bending kept at the folded-back portion, and the folded-back portion is wound up or rewound with folding, with the bending radius being kept at 4 mm to 8 mm.

3. The flat cable according to claim 1, wherein an elongation of each of the conductors is less than 5%.

4. The flat cable according to claim 1, wherein the conductors each comprises fine precipitation having a grain size of smaller than 10 nm.

5. A method for manufacturing the flat cable comprising:

preparing a predetermined number of conductors each comprising one or more of 0.1 to 0.8 mass % of tin, 0.05 to 0.8 mass % of magnesium, 0.01 to 0.5 mass % of chromium, 0.1 to 5.0 mass % of zinc, 0.02 to 0.3 mass % of titanium, 0.01 to 0.2 mass % of zirconium, 0.01 to 3.0 mass % of iron, 0.001 to 0.2 mass % of phosphorus, 0.01 to 0.3 mass % of silicon, 0.01 to 0.3 mass % of silver, and 0.1 to 1.0 mass % of nickel, with a balance comprising copper and inevitable impurities, and satisfying $Y \geq 1.2 \times t \times E/(2X-t)$ within a range of bending radius of 4 mm to 8 mm, where X (mm) denotes bending radius, Y (MPa) denotes 0.2% yield stress, t (mm) denotes thickness, and E (MPa) denotes Young's modulus, the conductors each having an electrical conductivity of greater than or equal to 50% IACS, the conductors being manufactured by a method comprising:

performing a heat treatment under heat treatment conditions in which a heating temperature is 200 to 900° C. and a heating duration is 5 seconds to 4 hours, the heat treatment being one of a recrystallization heat treatment and an aging heat treatment, the recrystallization heat treatment being performed to obtain crystal grains having a grain size of 12 μm, or smaller, the crystal grains obtained by recrystallization being flattened such that a ratio of length/breadth of each of the crystal grains is 1.5 to 15, the aging heat treatment being performed to cause fine precipitation having a grain size of smaller than 10 nm, the conductors each having a width of 0.1 mm to 15 mm, a thickness of 0.02 mm to 0.05 mm, and having a width-direction cross-sectional area of less than or equal to 0.75 $mm^2$; and sandwiching the predetermined number of conductors by a pair of insulating films with an adhesive interposed therebetween, with a tension of greater than or equal to 0.3 kgf applied to each of the predetermined number of conductors.

6. A rotatable connector device comprising: a flat cable including a predetermined number of conductors, a pair of insulating films disposed in such a manner as to sandwich the predetermined number of conductors, and an adhesive layer provided between the pair of insulating films, the conductors each comprising one or more of 0.1 to 0.8 mass % of tin, 0.05 to 0.8 mass % of magnesium, 0.01 to 0.5 mass % of chromium, 0.1 to 5.0 mass % of zinc, 0.02 to 0.3 mass % of titanium, 0.01 to 0.2 mass % of zirconium, 0.01 to 3.0 mass % of iron, 0.001 to 0.2 mass % of phosphorus, 0.01 to 0.3 mass % of silicon, 0.01 to 0.3 mass % of silver, and 0.1 to 1.0 mass % of nickel, with a balance comprising copper and inevitable impurities, and satisfying $Y \geq 1.2 \times t \times E/(2X-t)$ within a range of bending radius of 4 mm to 8 mm, where X (mm) denotes bending radius, Y (MPa) denotes 0.2% yield stress, t (mm) denotes thickness, and E (MPa) denotes Young's modulus, the conductors each having an electrical conductivity of greater than or equal to 50% IACS, wherein a 0.2% yield stress of the flat cable in a longitudinal direction of the flat cable after 200000 bending movements that are performed with a bending radius of less than or equal to 8 mm being kept is greater than or equal to 80% of a 0.2% yield stress of the flat cable in the longitudinal direction before the bending movements, the conductors each having a width of 0.1 mm to 15 mm and a thickness of 0.02 mm to 0.05 mm.

7. The rotatable connector device according to claim 6, wherein the conductors each comprises fine precipitation having a grain size of smaller than 10 nm.

8. A method of manufacturing a flat cable comprising:

B manufacturing a predetermined number of conductors, the conductors each comprising one or more of 0.1 to 0.8 mass % of tin, 0.05 to 0.8 mass % of magnesium, 0.01 to 0.5 mass % of chromium, 0.1 to 5.0 mass % of zinc, 0.02 to 0.3 mass % of titanium, 0.01 to 0.2 mass % of zirconium, 0.01 to 3.0 mass % of iron, 0.001 to 0.2 mass % of phosphorus, 0.01 to 0.3 mass % of silicon, 0.01 to 0.3 mass % of silver, and 0.1 to 1.0 mass % of nickel, with a balance comprising copper and inevitable impurities, and satisfying $Y \geq 1.2 \times t \times E/(2X-t)$ within a range of bending radius of 4 mm to 8 mm, where X (mm) denotes bending radius, Y (MPa) denotes 0.2% yield stress, t (mm) denotes thickness, and E (MPa) denotes Young's modulus, the conductors each having an electrical conductivity of greater than or equal to 50% IACS, disposing a pair of insulating films disposed in such a manner as to sandwich the predetermined number of conductors; and providing an adhesive layer between the pair of insulating films, the manufacturing of the predetermined number of conductors including:

performing a heat treatment under heat treatment conditions in which a heating temperature is 200 to 900° C. and a heating duration is 5 seconds to 4 hours, the heat treatment being one of a recrystallization heat treatment and an aging heat treatment, the recrystallization heat treatment being performed to obtain crystal grains having a grain size of 12 μm or smaller, the crystal grains obtained by recrystallization being flattened such that a ratio of length/breadth of each of the crystal grains is 1.5 to 15, the aging heat treatment being performed to cause fine precipitation having a grain size of smaller than 10 nm, the conductors each having a width of 0.1 mm to 15 mm and a thickness of 0.02 mm to 0.05 mm.

9. The method according to claim 8, wherein the manufacturing of the predetermined number of conductors further includes performing finishing rolling after the heat treatment.

10. The method according to claim 8, wherein the manufacturing of the predetermined number of conductors further includes performing hot rolling at 600 to 1000° C. to obtain a plate material having a thickness of 10 mm to 20 mm and performing cold rolling such that the thickness of the plate material is reduced to 0.02 mm to 1.2 mm.

11. The method according to claim 8, wherein the manufacturing of the predetermined number of conductors further includes performing hot drawing and performing cold drawing.

* * * * *